US011568783B1

(12) United States Patent
Sahlsten et al.

(10) Patent No.: US 11,568,783 B1
(45) Date of Patent: Jan. 31, 2023

(54) DISPLAY DRIVERS, APPARATUSES AND METHODS FOR IMPROVING IMAGE QUALITY IN FOVEATED IMAGES

(71) Applicant: Varjo Technologies Oy, Helsinki (FI)

(72) Inventors: Oiva Arvo Oskari Sahlsten, Salo (FI); Mikko Strandborg, Hangonkylä (FI)

(73) Assignee: Varjo Technologies Oy, Helsinki (FI)

( * ) Notice: Subject to any disclaimer, the term of this patent is extended or adjusted under 35 U.S.C. 154(b) by 0 days.

(21) Appl. No.: 17/404,332

(22) Filed: Aug. 17, 2021

(51) Int. Cl.
*G09G 3/20* (2006.01)

(52) U.S. Cl.
CPC ... *G09G 3/2003* (2013.01); *G09G 2300/0452* (2013.01); *G09G 2310/04* (2013.01); *G09G 2340/0407* (2013.01)

(58) Field of Classification Search
None
See application file for complete search history.

(56) References Cited

U.S. PATENT DOCUMENTS

2017/0287447 A1* 10/2017 Barry ..... G02B 27/0093

* cited by examiner

*Primary Examiner* — Yingchun He
(74) *Attorney, Agent, or Firm* — Ziegler IP Law Group, LLC

(57) ABSTRACT

A display apparatus including display, display driver, and processor configured to send input signal to display driver, first part and second part of input signal comprise first pixel data pertaining to portion of first image frame and second pixel data pertaining to second image frame, respectively, first part of input signal further comprises extra pixel data pertaining to second image frame. Display driver is configured to: re-scale pixels of first pixel data based on display resolution; update pixels of second pixel data based on extra pixel data; generate control signal based on re-scaled pixels and updated pixels; drive display using control signal to present visual scene, wherein re-scaled pixels surround updated pixels when displayed on display area.

21 Claims, 3 Drawing Sheets

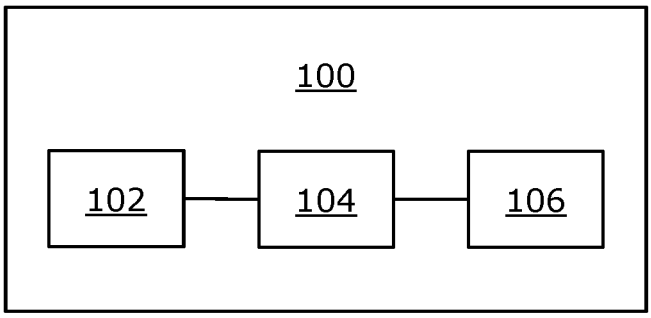
FIG. 1
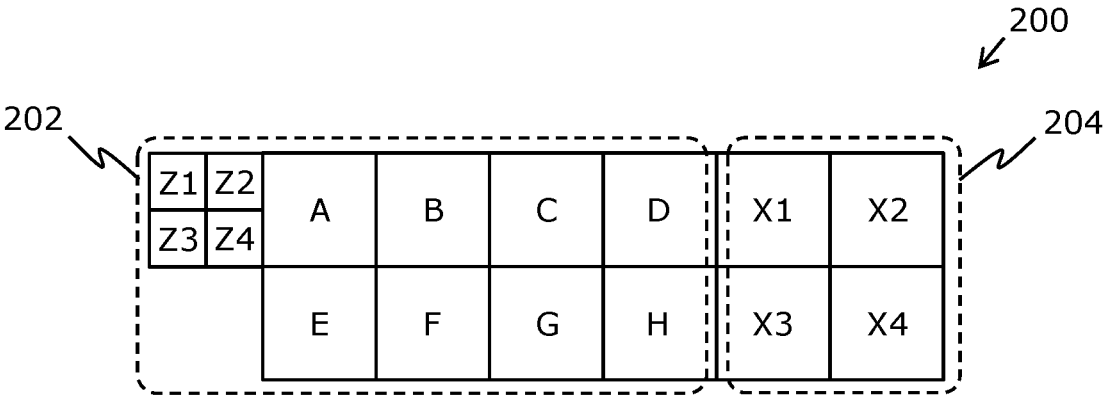
FIG. 2A
| | | | | | |
|---|---|---|---|---|---|
| A1 | A2 | B1 | B2 | C1 | C2 |
| A3 | A4 | B3 | B4 | C3 | C4 |
| H1 | H2 | Z1,X1 | Z2,X2 | D1 | D2 |
| H3 | H4 | Z3,X3 | Z4,X4 | D3 | D4 |
| G1 | G2 | F1 | F2 | E1 | E2 |
| G3 | G4 | F3 | F4 | E3 | E4 |
FIG. 2B

DISPLAY DRIVERS, APPARATUSES AND METHODS FOR IMPROVING IMAGE QUALITY IN FOVEATED IMAGES

TECHNICAL FIELD

The present disclosure relates to display apparatuses for improving image quality in foveated images. The present disclosure also relates to display drivers for improving image quality in foveated images. The present disclosure further relates to methods for improving image quality in foveated images.

BACKGROUND

Display apparatuses are widely used across several industries to display images for many applications such as extended-reality (XR) applications, entertainment, sports, surveillance, education, and the like. Generally, display apparatuses employ display drivers to drive displays included in display apparatuses. Nowadays, display apparatuses are also being used to present foveated images.

Some modern display drivers control each display component of a display by applying a specific control signal in the form of voltages, such that the display displays a foveated image corresponding to foveated input signals. In such cases, the foveated input signal serves as an input to the display drivers and generally comprises of two regions (arranged, for example, side-by-side with respect to each other), wherein a first region is up-scaled by the display drivers to fill the entire display, and a second region is overlaid on top of the first region by the display drivers according to a configurable offset. This allows for providing a higher resolution area at the second region as compared to the rest of the displayed foveated image.

However, an image quality of such foveated images produced by employing the modern display drivers in the display apparatuses is not up to the mark. As an example, foveated images being used for XR typically require a maximum resolution emulating human-eye resolution (for example, such as 60 pixels per degree), a high colour depth, and the like, in the higher resolution area. This is presently not feasible with the modern display drivers, and the perceivable loss in the image quality of the foveated images reduces the user's immersion within the XR environment.

Therefore, in light of the foregoing discussion, there exists a need to overcome the aforementioned drawbacks associated with display apparatuses presenting foveated images by employing display drivers.

SUMMARY

The present disclosure seeks to provide a display apparatus for improving image quality in foveated images. The present disclosure also seeks to provide a display driver for improving image quality in foveated images. The present disclosure further seeks to provide a method for improving image quality in foveated images. An aim of the present disclosure is to provide a solution that overcomes at least partially the problems encountered in prior art.

In one aspect, an embodiment of the present disclosure provides a display apparatus comprising:

a display; and a display driver connected to the display; and a processor, connected to the display driver, configured to send an input signal to the display driver, wherein at least a first part and a second part of the input signal comprise first pixel data pertaining to a portion of a first image frame and second pixel data pertaining to a second image frame, respectively, wherein the first part of the input signal further comprises extra pixel data pertaining to the second image frame, wherein the display driver is configured to:

re-scale pixels of the first pixel data based on a display resolution of the display;

update pixels of the second pixel data based on the extra pixel data;

generate a control signal based on the re-scaled pixels of the first pixel data and the updated pixels of the second pixel data; and drive the display using the control signal to present a visual scene, wherein the re-scaled pixels of the first pixel data surround the updated pixels of the second pixel data when displayed on a display area of the display.

In another aspect, an embodiment of the present disclosure provides a display driver configured to:

receive an input signal from a processor, wherein at least a first part and a second part of the input signal comprise first pixel data pertaining to a portion of a first image frame and second pixel data pertaining to a second image frame, respectively, wherein the first part of the input signal further comprises extra pixel data pertaining to the second image frame;

re-scale pixels of the first pixel data based on a display resolution of a display;

update pixels of the second pixel data based on the extra pixel data;

generate a control signal based on the re-scaled pixels of the first pixel data and the updated pixels of the second pixel data; and drive the display using the control signal to present a visual scene, wherein the re-scaled pixels of the first pixel data surround the updated pixels of the second pixel data when displayed on a display area of the display.

In yet another aspect, an embodiment of the present disclosure provides a method comprising:

receiving an input signal at a display driver, wherein at least a first part and a second part of the input signal comprise first pixel data pertaining to a portion of a first image frame and second pixel data pertaining to a second image frame, respectively, wherein the first part of the input signal further comprises extra pixel data pertaining to the second image frame, re-scaling, at the display driver, pixels of the first pixel data based on a display resolution of a display;

updating, at the display driver, pixels of the second pixel data based on the extra pixel data;

generating, at the display driver, a control signal based on the re-scaled pixels of the first pixel data and the updated pixels of the second pixel data; and driving the display using the control signal to present a visual scene, wherein the re-scaled pixels of the first pixel data surround the updated pixels of the second pixel data when displayed on a display area of the display.

Embodiments of the present disclosure substantially eliminate or at least partially address the aforementioned problems in the prior art, and enable presentation of high-quality foveated images in the display apparatus.

Additional aspects, advantages, features and objects of the present disclosure would be made apparent from the drawings and the detailed description of the illustrative embodiments construed in conjunction with the appended claims that follow.

It will be appreciated that features of the present disclosure are susceptible to being combined in various combinations without departing from the scope of the present disclosure as defined by the appended claims.

BRIEF DESCRIPTION OF THE DRAWINGS

The summary above, as well as the following detailed description of illustrative embodiments, is better understood when read in conjunction with the appended drawings. For the purpose of illustrating the present disclosure, exemplary constructions of the disclosure are shown in the drawings. However, the present disclosure is not limited to specific methods and instrumentalities disclosed herein. Moreover, those skilled in the art will understand that the drawings are not to scale. Wherever possible, like elements have been indicated by identical numbers.

Embodiments of the present disclosure will now be described, by way of example only, with reference to the following diagrams wherein:

FIG. 1 illustrates a block diagram of architecture of a display apparatus, in accordance with an embodiment of the present disclosure;

FIG. 2A is an exemplary illustration of a first part and a second part of an input signal, while FIG. 2B is an exemplary illustration of pixels constituting a visual scene, in accordance with an embodiment of the present disclosure;

FIG. 3A illustrates a given group of neighbouring pixels in second pixel data, while

Figure 3A:
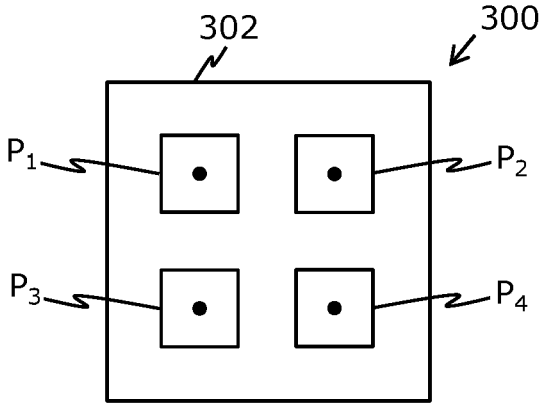

In the accompanying drawings, an underlined number is employed to represent an item over which the underlined number is positioned or an item to which the underlined number is adjacent. A non-underlined number relates to an item identified by a line linking the non-underlined number to the item. When a number is non-underlined and accompanied by an associated arrow, the non-underlined number is used to identify a general item at which the arrow is pointing.

DETAILED DESCRIPTION OF EMBODIMENTS

The following detailed description illustrates embodiments of the present disclosure and ways in which they can be implemented. Although some modes of carrying out the present disclosure have been disclosed, those skilled in the art would recognize that other embodiments for carrying out or practising the present disclosure are also possible.

In one aspect, an embodiment of the present disclosure provides a display apparatus comprising:

a display; and a display driver connected to the display; and a processor, connected to the display driver, configured to send an input signal to the display driver, wherein at least a first part and a second part of the input signal comprise first pixel data pertaining to a portion of a first image frame and second pixel data pertaining to a second image frame, respectively, wherein the first part of the input signal further comprises extra pixel data pertaining to the second image frame, wherein the display driver is configured to:

re-scale pixels of the first pixel data based on a display resolution of the display;

update pixels of the second pixel data based on the extra pixel data;

generate a control signal based on the re-scaled pixels of the first pixel data and the updated pixels of the second pixel data; and drive the display using the control signal to present a visual scene, wherein the re-scaled pixels of the first pixel data surround the updated pixels of the second pixel data when displayed on a display area of the display.

In another aspect, an embodiment of the present disclosure provides a display driver configured to:

receive an input signal from a processor, wherein at least a first part and a second part of the input signal comprise first pixel data pertaining to a portion of a first image frame and second pixel data pertaining to a second image frame, respectively, wherein the first part of the input signal further comprises extra pixel data pertaining to the second image frame;

re-scale pixels of the first pixel data based on a display resolution of a display;

update pixels of the second pixel data based on the extra pixel data;

generate a control signal based on the re-scaled pixels of the first pixel data and the updated pixels of the second pixel data; and drive the display using the control signal to present a visual scene, wherein the re-scaled pixels of the first pixel data surround the updated pixels of the second pixel data when displayed on a display area of the display.

In yet another aspect, an embodiment of the present disclosure provides a method comprising:

receiving an input signal at a display driver, wherein at least a first part and a second part of the input signal comprise first pixel data pertaining to a portion of a first image frame and second pixel data pertaining to a second image frame, respectively, wherein the first part of the input signal further comprises extra pixel data pertaining to the second image frame, re-scaling, at the display driver, pixels of the first pixel data based on a display resolution of a display;

updating, at the display driver, pixels of the second pixel data based on the extra pixel data;

generating, at the display driver, a control signal based on the re-scaled pixels of the first pixel data and the updated pixels of the second pixel data; and driving the display using the control signal to present a visual scene, wherein the re-scaled pixels of the first pixel data surround the updated pixels of the second pixel data when displayed on a display area of the display.

The present disclosure provides the aforementioned display apparatus, the aforementioned display driver, and the aforementioned method. In the display apparatus, certain bits in a (foveated) input signal, which would conventionally have belonged to certain pixels of the first pixel data and would have been otherwise wasted due to the certain pixels of the first pixel data being overlapped by corresponding pixels of the second pixel data, are beneficially repurposed to provide the extra pixel data. When these certain bits carry the extra pixel data instead of the certain pixels of the first pixel data, as in the display apparatus described herein, it increases greatly an image quality of foveated images (i.e., foveated visual scenes) presented by the display apparatus. The display driver of the display apparatus effectively re-scales pixels of the first pixel data to fit an entirety of the display, updates pixels of the second pixel data with the extra pixel data to improve an image quality of the second image frame, and finally displays the (foveated) visual scene with the re-scaled pixels of the first pixel data surrounding the updated pixels of the second pixel data at the display. A quality of this visual scene is suitable for various applications, for example, such as extended-reality (XR) applications. Moreover, the display driver and method described herein are easy to implement, and efficient.

Throughout the present disclosure, the term "display apparatus" refers to specialized equipment that is configured to present visual scenes. The visual scenes presented by the display apparatus are optionally foveated visual scenes (i.e., visual scenes having a variable resolution that emulates human eye viewing characteristics). Optionally, the display apparatus is configured to present a visual scene of an extended-reality (XR) environment to a user. Optionally, the display apparatus comprises of one display per eye of the user. Examples of display apparatuses include, but are not limited to, a display console, a head-mounted display (HMD), a television, a desktop computer, a laptop computer, a tablet computer, a phablet, a smartphone, a smartwatch, a projection device (such as a projector).

In some implementations, the display apparatus in operation is worn by the user on his/her head, and acts as an XR device (for example, such as an XR headset, a pair of XR glasses, and the like) that is operable to present the visual scene of the XR environment to the user. In such an instance, the "display apparatus" is referred to as "head-mounted display apparatus", for the sake of convenience only. In other implementations, the display apparatus is not worn by the user and the user interacts with the display apparatus externally. In such an instance, the display apparatus may be controllable using touch input, voice input, an input device, a remote controller, and the like. Throughout the present disclosure, the term "extended-reality" encompasses virtual reality (VR), augmented reality (AR), mixed reality (MR), and the like. The display apparatus may be used for a variety of applications including, but not limited to, extended-reality (XR), inspection of the real-world environment, machine vision, gaming, art, and so forth.

Throughout the present disclosure, the term "display" refers to an output device utilised to present the visual scene to the user. In some implementations, the display apparatus comprises a single display, whereas in other implementations, the display apparatus comprises a plurality of displays. Optionally, the plurality of displays are arranged in a tiled manner to form a multi-screen arrangement. Optionally, the display is implemented as one of: a Liquid Crystal Display (LCD), a Light Emitting Diode (LED)-based display, an Organic LED (OLED)-based display, a micro OLED-based display, and a Liquid Crystal on Silicon (LCoS)-based display.

Optionally, the display comprises a plurality of light-emitting elements, wherein the plurality of light-emitting elements are controllable for displaying the visual scene at the display. The plurality of light-emitting elements are driven using the control signal. In an example, the display may be implemented as the LCD which may have a plurality of liquid crystal (LC) molecules. In another example, the display may be implemented as the LED-based display which may have a plurality of light emitting diodes (LEDs).

It will be appreciated that the display could be a multi-resolution display, or a single-resolution display. Multi-resolution displays are configured to present the visual scene at two or more display resolutions, whereas single-resolution displays are configured to present the visual scene at a single display resolution only. Herein, the term "display resolution" of the display refers to a total number of pixels in each dimension of the display, or to a pixel density (namely, a number of pixels per unit distance or area) in the display.

Optionally, a given pixel comprises at least one sub-pixel. A given sub-pixel is a separately addressable single-colour picture element. In some implementations, the given pixel comprises a single sub-pixel, whereas in other implementations, the given pixel comprises a plurality of sub-pixels. As an example, the given pixel may comprise three sub-pixels in a Red-Green-Blue (RGB) sub-pixel arrangement, wherein the given pixel comprises a red sub-pixel, a green sub-pixel, and a blue sub-pixel that are arranged in a one-dimensional array. As another example, the given pixel may comprise five sub-pixels in a Red-Red-Green-Green-Blue (RRGGB) sub-pixel arrangement, wherein the given pixel comprises two red sub-pixels, two green sub-pixels, and one blue sub-pixel that are arranged in a PenTile® matrix layout.

Throughout the present disclosure, the term "display driver" refers to a device which drives the display to present the visual scene to the user. The display driver serves as an interfacing element between the display and the processor. Herein, the display driver may be an LCD display driver, an LED display driver integrated circuit (DDIC), a touches controller indicator circuit (TCIC), or similar. The display driver is selected based on a type of the display implemented in the display apparatus. Optionally, the display driver is implemented as a semiconductor integrated circuit (IC). Alternatively, optionally, the display driver comprises a software module, wherein the software module pertains to a state machine made of discrete logic and a plurality of components.

Optionally, based on a type of the display, the display driver generates a plurality of drive voltages to be applied to a plurality of circuit lines of the display according to pixel data (for example, such as the first pixel data, the second pixel data, and the extra pixel data). Optionally, in this regard, the control signal comprises information indicative of the plurality of drive voltages. Optionally, the display driver accepts commands and/or data from the processor, using a data communication interface. Examples of the data communication interface include, but are not limited to, a DisplayPort interface, a mobile industry processor interface (MIPI), a high-definition multimedia interface (HDMI), a transistor-transistor logic (TTL) interface, a complementary metal oxide semiconductor (CMOS) interface, and a serial peripheral interface (SPI).

In some implementations, the display driver is integrated with the display. In such implementations, the display driver is physically coupled (i.e., connected) to the display (for example, attached via mechanical and/or electrical connections to the display). In other implementations, the display driver is implemented on an external device that is separate from the display. In such implementations, the display driver and the display are communicably coupled (i.e., communicably connected).

The processor refers to hardware, software, firmware, or a combination of these, that controls overall operation of the display apparatus. The processor and the display driver are communicably coupled (i.e., communicably connected). The term "input signal" refers to a signal which serves as an input to the display driver, wherein the display driver manipulates said signal to eventually generate the control signal for driving the display. Based on the input signal, the display driver determines the plurality of drive voltages (namely, the control signal) to be applied to the plurality of circuit lines of the display. Herein, the plurality of drive voltages may be analogue voltage levels.

Optionally, when the input signal has two parts (namely, the first part and the second part), the input signal comprises the pixel data pertaining to two image frames (namely, the first image frame and the second image frame), such that a single level of foveation is provided in the visual scene. Herein, the first pixel data comprised in the first part of the input signal pertains to an entire field of view (FOV) of the visual scene, while the second pixel data comprised in the second part pertains to a given portion of the FOV. It will be appreciated that the second pixel data is used to generate pixels that are displayed at a higher resolution at the display, as compared to pixels generated from the first pixel data. This means that the pixels generated from the second part of the input signal provide a greater degree of visual detail at the display, as compared to the pixels generated from the first part. An exemplary input signal has been illustrated in conjunction with FIG. 2A, for the sake of clarity. The term "portion of the first image frame" refers to a peripheral portion of the FOV of the visual scene, which surrounds the given portion of the FOV (represented by the second image frame). In other words, the peripheral portion of the FOV, represented in the portion of the first image frame, does not overlap with the given portion of the FOV represented in the second image frame.

Alternatively, optionally, when the input signal has more than two parts, the input signal comprises the pixel data pertaining to more than two image frames (for example, the first image frame, the second image frame and at least one additional image frame), such that more than two levels of foveation are provided in the visual scene. Herein, the first pixel data comprised in the first part of the input signal pertains to an entire field of view (FOV) of the visual scene, the second pixel data comprised in the second part pertains to a first portion of the FOV, and additional pixel data comprised in at least one additional part pertains to at least one second portion within the FOV. It will be appreciated that the second pixel data, the additional pixel data and the first pixel data are used to generate corresponding pixels that are displayed at a highest resolution, at least one intermediate resolution and a lowest resolution, respectively, at the display.

Optionally, at least the first image frame and the second image frame are generated by the processor. A given image frame may represent at least one real-world object, at least one virtual object, or a combination of both real-world and virtual objects. Alternatively, optionally, at least the first image frame and the second image frame are received by the processor from an external device communicably coupled to the processor. The external device may be a computing device comprising a Graphics Processing Unit (GPU), a cloud server, a data repository, and the like.

The term "pixel data" refers to data comprising a measure of at least one characteristic of the given pixel. Optionally, the at least one characteristic of the given pixel may be a colour of the pixel, a depth of the pixel, an opacity of the pixel, a texture of the pixel, and the like. The term "extra pixel data" refers to extra data that is to be employed by the display driver to improve an image quality of the second image frame. Beneficially, the first part of the input signal does not include pixel data pertaining to a remaining portion of the first image frame onto which the second image frame is to be overlaid. Instead, the first part comprises the extra pixel data, which is advantageously employed to improve greatly the image quality of the second image frame, by effectively supplementing the second pixel data.

It will be appreciated that the pixels of the second image frame are to be displayed at a higher quality (i.e., with a higher degree of visual detail) as compared to the pixels of the first image frame, in order to display the visual scene in a foveated manner. The extra pixel data pertains to the second image frame, and provides additional information related to the second image frame. In other words, the second pixel data is supplemented with the extra pixel data for improving an image quality of the second image frame.

Re-scaling of the given pixel means that a scale of the given pixel is changed (for example, increased or decreased) as per the display resolution of the display. Optionally, the pixels generated from the first pixel data are up-scaled based on the display resolution of the display. In up-scaling, the resolution of the first pixel data is decreased as a single pixel is used to generate multiple pixels. Optionally, the pixels of the first pixel data are re-scaled (i.e., up-scaled) such that the pixels fill an entirety of the display area of the display. In an example, when the display resolution of the display is more than the resolution of the first pixel data, the pixels of the first pixel data would be up-scaled to fit the display area. Notably, in a 1:q×r up-scaling of a given pixel, the given pixel is up-scaled to generate a grid of q×r pixels. For example, in a 1:2×2 up-scaling, one pixel is up-scaled to generate four pixels that are arranged in a 2×2 grid.

Since the extra pixel data provides the extra data for improving the image quality of the second image frame, the pixels generated from the second pixel data are updated according to the extra data. Conventionally, only the second pixel data is used to generate the pixels of the second image frame. Pursuant to embodiments of the present disclosure, with the addition of the extra pixel data pertaining to the pixels of the second image, more data (i.e., original data from the second pixel data and extra data from the extra pixel data) is available for each pixel of the second image frame. A technical effect of employing such an input signal having the extra pixel data is that it improves a quality of the pixels of the second image frame. Beneficially, the updated pixels of the second pixel data have a higher resolution (i.e., a higher degree of visual detail) as compared to a resolution of the re-scaled pixels of the first pixel data that would surround the updated pixels of the second pixel data. Herein, the visual scene has variable resolution, such that the resolution varies spatially throughout the visual scene.

The term "control signal" refers to a signal which serves as an output of the display driver for driving the display to present the visual scene. The control signal is utilised to control a plurality of pixels in the display to present the visual scene. Optionally, the control signal is generated to include analogue voltage levels corresponding to the re-scaled pixels of the first pixel data and the updated pixels of the second pixel data. As the control signal is generated according to the re-scaled pixels and the updated pixels, the control signal is more comprehensive as compared to the input signal.

Optionally, the control signal is updated based on a frame rate at which visual scenes are presented. The frame rate may, for example, lie in a range of 20 frames per second (FPS) to 120 FPS. As an example, the frame rate may be 90 FPS. It will be appreciated that multiple unique visual scenes would require multiple unique input signals, and thereon, generate multiple unique control signals based on the multiple unique visual scenes to be displayed.

In an embodiment, for a given pixel of the second pixel data, the extra pixel data comprises an M/N bit chunk that is to be added to an initial value of a given colour component of the given pixel comprised in the second pixel data, wherein M is a colour depth of the pixels of the first pixel data, and N is selected from the group consisting of 2, 3, 4, 6, 8, 9, 12 and 16, wherein, when updating the pixels of the second pixel data, the display driver is configured to append the M/N bit chunk to the initial value of the given colour component of the given pixel, to generate an updated value of the given colour component of the given pixel. In this regard, the extra pixel data is used for improving a colour reproduction capability of the pixels of the second pixel data. The given pixel is associated with at least one colour component. Optionally, the at least one colour component comprise a red colour component, a green colour component, and a blue colour component.

The term "colour depth" refers to a number of bits used to indicate a given value of the given colour component of the given pixel. When the number of bits is high, the colour depth is high, and vice versa. Herein, one or more bits may be utilised for expressing values of the colour components. The colour depth may be 8 bits, 10 bits, 12 bits, 16 bits, 24 bits, and so forth. As an example, when the colour depth is equal to 8 bits, the given value of the given colour component of the given pixel lies in a range of 0-255, and is chosen from amongst a total of 256 values. As another example, when the colour depth is equal to 10 bits, the given value of the given colour component of the given pixel lies in a range of 0-1023, and is chosen from amongst a total of 1024 values. The given value of the given colour component may be represented as an actual value of the given colour component, or as a normalised value of the given colour component. Normalisation refers to changing a scale of a given range, such that one range may be conveyed in terms of another range. For example, when the colour depth of the given pixel is equal to 8 bits, a range for actual values of the given colour component is 0-255, which is normalised to a new range of 0-1, wherein normalized values of the given colour component lie within the new range. The initial value of the given colour component of the given pixel is determined based on the second pixel data. Moreover, the updated value of the given colour component of the given pixel would have more bits as compared to the initial value since the M/N bit chuck is appended to the initial value.

It will be appreciated that re-scaling modes are distinguished by an extent of re-scaling which is to be performed for the given pixel. Values in the group from which N is selected depend on these re-scaling modes. Herein, for example, the value of N being equal to 2 indicates a 1:2×1 and/or a 1:1×2 upscaling mode; the value of N being equal to 3 indicates a 1:3×1 and/or a 1:1×3 upscaling mode; the value of N being equal to 4 indicates a 1:2×2 upscaling mode; the value of N being equal to 6 indicates a 1:2×3 and/or a 1:3×2 upscaling mode; the value of N being equal to 8 indicates a 1:4×2 and/or a 1:2×4 upscaling mode; the value of N being equal to 9 indicates a 1:3×3 upscaling mode; the value of N being equal to 12 indicates a 1:4×3 and/or a 1:3×4 upscaling mode; the value of N being equal to 16 indicates a 1:4×4 upscaling mode. Optionally, other values of N for other rescaling modes are also feasible. As an example, N can also have other values, such as, 5, 10, 15, 20, 25, and 30; indicating 1:5×1, 1:5×2, 1:5×3, 1:5×4, 1:5×5, and 1:5×6 upscaling modes, respectively.

In an example, the first part and the second part of the input signal have identical resolutions. The display driver may up-scale the pixels of the first pixel data using a 1:2×2 upscaling to fill the entire display. The pixels of the second pixel data may be displayed at a given location (which may be a freely selectable location) on the display without being re-scaled. In one case, each colour component of the pixels of the first pixel data may have 8 bits of colour depth, and every 2×2 block of 4 pixels in the second image frame may overlap with a single re-scaled pixel in the first image frame. This means that, every colour component of the pixel in the second image frame is provided with an extra 8/4=2-bits chunk of extra pixel data. In another case, each colour component of the pixel data may have 10 bits of colour depth, which means that every colour component of the pixel is provided with an extra 10/4=2.5 bits chunk of extra pixel data. Such fractional bits may be employed by arithmetic encoding.

The M/N bit chunk refers to an amount of data expressed in bits, which assists in generating the updated value of the given colour component of the given pixel by serving as a supplement to the initial value of the given colour component of the given pixel. For example, if the colour depth of the pixels of the first pixel data (M) is assumed to be an 8-bit value, and an up-scaling mode of the second pixel data may be 1:2×2 (i.e., 1:4), such that N=4, the M/N bit chunk has a size that is equal to 8/4 bits, i.e., 2 bits. This 2-bit chunk is appended to the initial value of the given colour component of the given pixel, upon which, the updated pixel value is expressed as 8+2 bits, i.e., 10 bits. Beneficially, the extra pixel data provides more colour depth to the pixels of the second pixel data by increasing a range of colours that can be represented by the given pixel. Herein, when the initial value is a normalized 8-bit value (i.e., 0 is normalised to 0.0, and 255 is normalised to 1.0), the 2 bits (calculated as the M/N bit chunk) are appended to the initial value to get a 10-bit value. In such a case, the given pixel, which earlier could display any colour from amongst 256 colours, can now display any colour from amongst 1024 colours. However, mathematically, during appending, the initial value is shifted 2 bits to the left, and then the 2 bits are added to the result. Therefore, the updated value is interpreted as a normalized 10-bit value (i.e., 0 is normalised to 0.0, and 1023 is normalised to 1.0).

It will be appreciated that a colour depth of pixels in the display is not limited. When the display is implemented as the LCD display, the LC molecules are rotated and reoriented using the analogue voltage levels to represent different colours. This means that the control signal serves as the only limitation due to which a certain number of colours can be represented by the given pixel of the display. Greater an amount of pixel data for the given pixel in the control signal, greater is the number of colours which can be represented by the display. Beneficially, the extra pixel data may be utilised for providing extra colour depth, at least to the pixels of the second pixel data, such that the control signal is supplemented (i.e., enhanced) to convey an increased number of analogue voltage levels for providing an increased colour depth (i.e., an increased range of colours) for the pixels of the second pixel data, in the visual scene.

In another embodiment, for a given pixel of the second pixel data, the extra pixel data comprises at least one most significant bit of a previous output value of a given colour component of a corresponding pixel in an image frame displayed previously via the display, wherein, when updating the pixels of the second pixel data, the display driver is configured to:

determine an amount of overdrive or underdrive required to be applied to an initial value of the given colour component of the given pixel comprised in the second pixel data, based on a difference between the at least one most significant bit of the previous output value and the initial value of the given colour component of the given pixel; and apply the determined amount of overdrive or underdrive to the initial value of the given colour component of the given pixel, to generate an updated value of the given colour component of the given pixel.

In this regard, the extra pixel data is used for determining the amount of overdrive or underdrive to be applied. The amount of overdrive or underdrive may be determined when the display is implemented, for example, as the LCD display. Typically, in the LCD display, light passing through a liquid-crystal medium comprising the LC molecules is adjusted by rotating the LC molecules to different orientation for different pixels, such that required colour of light is emitted for the different pixels. It will be appreciated that overdrive or underdrive may be required to be applied since a response time of the LCD display may not always be suitable for a given application. In case of "overdrive", when the initial value of the given colour component is higher than the previous output value of the given colour component, the updated value of the given colour component is generated to be higher than the initial value; accordingly, a higher initial voltage (corresponding to the updated value) is provided to the display as compared to a voltage originally required to achieve the initial value of the given colour component, and then, the provided voltage is moderated in order to rotate the LC molecules to an orientation required to achieve the initial value of the given colour component in a required time (as per the frame rate), and vice versa. In case of "underdrive", when the initial value is higher than the previous output value, the updated value is generated to be lower than the initial value but higher than the previous output value; accordingly, a lower initial voltage (corresponding to the updated value) is provided to the display as compared to the voltage originally required, and then, the provided voltage is moderated in order to rotate the LC molecules to the required orientation in the required time, and vice versa. In some cases, underdrive may be beneficially employed for pixels in the second pixel data depending on visual content to be represented by such pixels.

The term "most significant bit" refers to a bit that is furthest to left (i.e., a leftmost bit) in a binary number. Since the bit furthest to left in the binary number contributes the most to a value of the binary number as compared to other bits of the binary number, the bit furthest to left is termed to be the most significant bit. It will be appreciated that the at least one most significant bit provides a closest approximation of the previous output value of the given colour component. Beneficially, the previous output value is used for accurately determining the amount of overdrive or underdrive, as the given pixel is to be controlled according to a change in values of given colour component from its previous output value to its initial value. In particular, an orientation of LC molecule(s) corresponding to the given pixel is controlled according to the change in values of given colour component from its previous output value to its initial value. The updated value of the given colour component of the given pixel is one that is generated upon response time compensation, so that upon generating the control signal according to the updated value, the initial value of the given colour component is accurately obtained in the visual scene. The at least one most significant bit may include one or more than one most significant bit. Optionally, a higher number of most significant bits are required when the colour depth of the pixels is high, as compared to when the colour depth of the pixels is low or moderate.

For illustration purposes only, there will now be considered an example in which the colour depth of the given colour component is 8 bits, the initial value of the given colour component of the given pixel is equal to 220, and a single most significant bit of the previous output value is provided to be equal to '1', indicating that the previous output value is equal to or greater than 128. In this example, the difference may be calculated as 220−128=92 between successive visual scenes, which indicates an amount of rotation required by a given LC molecule pertaining to the given pixel, wherein said rotation is to be completed within time T to achieve the desired initial value while displaying. When the response time of the LCD display is high, the given LC molecule would rotate slowly without overdrive being applied, to provide a value of, for example, 190 in the time T, instead of the value of 220. Therefore, the LCD display requires an overdrive to be applied. In this example, the amount of overdrive may be determined as a given voltage corresponding to an updated value of the given colour component of the given pixel equal to 250. When this amount of overdrive is applied to the given LC molecule, it eventually displays the initial value of 220 for the given colour component.

There will now be considered another example in which the colour depth of the given colour component is 8 bits, the initial value of the given colour component of the given pixel is equal to 50, and two most significant bits of the previous output value are provided to be equal to '11', indicating that the previous output value is equal to or greater than 192. In this example, the difference may be calculated as 192−50=142 between successive visual scenes, which indicates an amount of rotation required by a given LC molecule pertaining to the given pixel, wherein said rotation is to be completed within time T to achieve the desired initial value while displaying. When the response time of the LCD display is high, the given LC molecule will rotate slowly without overdrive being applied, for providing a value of, for example, 100 in time T, instead of the value of 50. Therefore, the LCD display requires an overdrive to be applied. In this example, the amount of overdrive may be determined as a given voltage corresponding to an updated value of the given colour component of the given pixel equal to 10. When this amount of overdrive is applied at the given LC molecule, it eventually displays the initial value of 50 for the given colour component.

Beneficially, generating the updated value of the given colour component by applying the determined amount of overdrive or underdrive results in a faster response time of the LC molecules in the display, and a decreased amount of ghosting or corona artifacts at the display, as compared to when no overdrive or underdrive were applied.

In yet another embodiment, for a given pixel of the second pixel data, the processor is configured to determine an amount of overdrive or underdrive required to be applied to an initial value of a given colour component of the given pixel comprised in the second pixel data, based on a difference between a previous output value of the given colour component of a corresponding pixel in an image frame displayed previously via the display and the initial value of the given colour component of the given pixel, wherein the extra pixel data comprises information indicative of the determined amount of overdrive or underdrive required to be applied, wherein, when updating the pixels of the second pixel data, the display driver is configured to apply the determined amount of overdrive or underdrive to the initial value of the given colour component of the given pixel, to generate an updated value of the given colour component of the given pixel.

The amount of overdrive or underdrive to be applied may be determined when the display is implemented, for example, as the LCD display, since light passing through a liquid-crystal medium comprising the LC molecules is adjusted (to provide different colours) by rotating the LC molecules to different orientations. The amount of overdrive or underdrive required to be applied may be determined by finding the difference between the previous output value of the given colour component and the initial value of the given colour component, since a given LC molecule corresponding to the given colour component is controlled according to a change in values of given colour component from its previous output value to its initial value. The term "information indicative of the determined amount of overdrive or underdrive required to be applied" comprises at least one of: a value of overdrive or underdrive to be applied, a change in voltage, an actual required voltage for applying overdrive or underdrive, a percentage change in voltage, and the like.

Beneficially, since the processor determines the amount of overdrive or underdrive required and provides the display driver with the information indicative of the determined amount of overdrive or underdrive required in the extra pixel data, the display driver is not required to perform additional steps for said determination, and instead, directly applies the determined amount of overdrive or underdrive to generate the updated value.

In still another embodiment, the extra pixel data comprises an extra pixel for a given group of neighbouring pixels in the second pixel data from which pixel values of a corresponding region of the display area are to be determined, and wherein, when generating the control signal, the display driver is configured to determine, from the neighbouring pixels of the given group and the extra pixel, the pixel values of the corresponding region of the display area. In this regard, the extra pixel provides extra resolution in the corresponding region of the display area. The extra pixel data comprises the extra pixel in a case where the display is not being run at the full native display resolution at the given portion of the FOV represented by the second image frame, or in a case where more than two levels of foveation are being used. In such cases, the display driver needs to up-scale at least one of the pixels of the second pixel data. Optionally, in this regard, the display driver is to up-scale all the pixels of the second pixel data. The display may be run in this manner to provide a gradual change of resolution in the visual scene (by optionally up-scaling the at least one of the pixels of the second pixel data and not scaling at least one remaining pixel of the pixels of the second pixel data). For example, if the pixels in the portion of the first image frame pertaining to the first pixel data is up-scaled (i.e., down-sampled) according to 1:4×4 scaling mode, and the pixels in the second image frame pertaining to the second pixel data is down-sampled to 1:2×2, the extra pixel may be provided.

Optionally, the pixel values of the corresponding region of the display area are determined from the neighbouring pixels of the given group and the extra pixel by performing signal reconstruction. This up-scaling process utilizes the neighbouring pixels of the given group and the extra pixel as input. In the signal reconstruction, the display driver reconstructs a signal at each physical pixel location of the display, based on pixel values of the neighbouring pixels of the given group and the extra pixel and on locations of the neighbouring pixels and the extra pixel. Optionally, when performing the signal reconstruction, the display driver is configured to employ at least one of: linear interpolation filtering, cubic interpolation filtering, for processing the pixel values of the neighbouring pixels of the given group and the extra pixel. Beneficially, the extra pixel enables in increasing a resolution of the corresponding region (i.e., pertaining to the second image frame) of the display area when the display driver up-scales the at least one of the pixels of the second pixel data. The extra pixel serves as an additional sample supplementing the neighbouring pixels of the given group, and then the up-scaling process is implemented. This increase in resolution is especially useful to mimic foveation in the visual scene.

Optionally, the given group of neighbouring pixels comprises four pixels in a quadrilateral arrangement, and wherein, when updating the pixels of the second pixel data, the display driver is configured to:

rearrange the four pixels by increasing a distance between each of the four pixels and a centre of the given group; and arrange the extra pixel at the centre of the given group.

In this regard, the four pixels may be arranged at the corners of the quadrilateral arrangement, and the extra pixel may be arranged at the centre of the quadrilateral arrangement. In such a case, the pixel values of the corresponding region of the display area may, for example, be determined by performing signal reconstruction. Such a given group of neighbouring pixels and the given group along with the extra pixel has been illustrated in conjunction with FIGS. 3A and 3B, respectively, for the sake of clarity.

Alternatively, optionally, the given group of neighbouring pixels comprises four pixels in a quadrilateral arrangement, and wherein, when updating the pixels of the second pixel data, the display driver is configured to:

rearrange the four pixels by increasing a distance between each of the four pixels;

rearrange a pixel arranged at a given corner of the given group to lie at a centre of the given group; and arrange the extra pixel at the given corner of the given group.

For example, the pixel arranged at a top left corner of the quadrilateral arrangement may be rearranged to lie at the centre, three of the four pixels may continue to be arranged at their respective corners and the extra pixel may be arranged at the top left corner of the given group. In such a case, the pixel values of the corresponding region of the display area may, for example, be determined by performing signal reconstruction.

It will be appreciated that each pixel of the second pixel data is typically associated with a unique position on the display area of the display. This means that, the pixels of the second pixel data are arranged at individual unique positions on the display area. During updating of the pixels of the second pixel data, at least one of the pixels of the second pixel data may get re-arranged and thereby associated with multiple positions in the display area. The term "re-arrangement of pixels" refers to a change in associated positions of the pixels. Optionally, when re-arranging the pixels of the given group of neighbouring pixels, a given pixel is re-arranged by sub-pixel amounts. In other words, the change in position of the given pixel is by a fraction of the given pixel. Optionally, distances between the pixels change as a result of re-arrangement. Alternatively, optionally, an arrangement of the pixels changes as a result of re-arrangement. The term "arrangement" refers to a first instance of association of each pixel with the unique position on the display area.

Optionally, updating the pixels of the second pixel data includes the steps of rearrangement of the pixels of the given group and arrangement of the extra pixel when the display is implemented as the LCD display. This is so because LC molecules can be effectively controlled to steer light passing therethrough, by application of requisite electrical signals (such as voltages), for pixel-shifting (i.e., changing positions of pixels). Optionally, the electrical signals applied by the control circuit control an orientation of the LC molecules. It will be appreciated that the given group of neighbouring pixels is not limited to any specific number of pixels or any specific arrangement of pixels. For example, the given group of neighbouring pixels may comprise 2, 3, 4, 6, 8, 9, 12, 16, and so forth, pixels, and an arrangement of such pixels may be linear, grid-like, polygonal, circular, elliptical, freeform, and the like.

Optionally, the input signal comprises information pertaining to a region within the display area of the display whereat the pixels of the second pixel data pertaining to the second image frame are to be displayed, and wherein the display driver is configured to generate the control signal in a manner that the updated pixels of the second pixel data are displayed at said region within the display area, while the re-scaled pixels of the first pixel data are displayed at a remaining region within the display area. In this regard, the region within the display area whereat the updated pixels of the second pixel data are displayed provides a high level of visual detail as compared to a remaining region of the display area. Beneficially, the information pertaining to the region assists the display driver to display the updated pixels of the second pixel data at the region and the re-scaled pixels of the first pixel data at the remaining region within the display area appropriately in the foveated manner.

Optionally, the information pertaining to the region within the display area is defined by a position of one corner of the region and dimensions of the region in pixels. As an example, in said information, the region may be defined by a position of a top-left corner of the region and dimensions of the region in horizontal and vertical directions. Additionally, optionally, the information pertaining to the region within the display area comprises at least one of: a position of at least one other corner of the region, a relative position of the one corner of the region with respect to a corner of the display, a size of the region, a relative size of the region with respect to a size of the display. Optionally, a position of a given point is expressed using a two-dimensional coordinate system. For example, the position of the one corner may be expressed as (100, 200) units, a horizontal dimension of the region may be 300 pixels, and a vertical dimension of the region may be 200 pixels. Optionally, the size of the region is expressed using square pixel units. Optionally, the information pertaining to the region within the display area is provided by the processor. Optionally, the processor is configured to generate the information pertaining to the region within the display area.

Optionally, the information pertaining to the region within the display area is generated according to a gaze direction of the user. In some implementations, the gaze direction of the user is considered to be towards a centre of the display, and therefore, the region within the display area of the display whereat the updated pixels of the second pixel data pertaining to the second image frame are to be displayed is a central region of the display. Generally, a user's gaze is directed towards a centre of his/her field of view. When the user wishes to view objects in a periphery of his/her field of view, the user typically turns his/her head in a manner that said objects lie at a centre of his/her current field of view. In such a case, the central portion of the user's field of view is resolved to a much greater degree of visual detail by the visual system of the user's eye, as compared to the peripheral portion of the user's field of view. This manner of determining said region within the display area for displaying the updated pixels of the second pixel data emulates a way in which users generally focus within their field of view. Therefore, this embodiment pertains to fixed-foveation-based displaying of the visual scene.

In other implementations, the gaze direction of the user is determined using a gaze-tracking means, which is optionally comprised in the display apparatus, such that the gaze-tracking means is communicably coupled to the processor. The gaze-tracking means refers to a specialized equipment for detecting and/or following the gaze direction of the user, when the display apparatus in operation is worn by the user. The gaze-tracking means could be implemented as contact lenses with sensors, cameras monitoring a position of a pupil of the user's eye, and the like. Such gaze-tracking means are well-known in the art. The gaze-tracking means is configured to collect gaze-tracking data and send it to the processor. Optionally, the gaze-tracking data is processed to determine a gaze vector, which is mapped to the display area to determine the position of the one corner of the region and the dimensions of the region in pixels. It will be appreciated that the gaze-tracking data is collected repeatedly by the gaze-tracking mean throughout a given session of using the display apparatus, as the gaze direction of the user's eyes keeps changing whilst he/she uses the display apparatus.

The present disclosure also relates to the display driver as described above. Various embodiments and variants disclosed above, with respect to the aforementioned first aspect, apply mutatis mutandis to the display driver.

In an embodiment, for a given pixel of the second pixel data, the extra pixel data comprises an M/N bit chunk that is to be added to an initial value of a given colour component of the given pixel comprised in the second pixel data, wherein M is a colour depth of the pixels of the first pixel data, and N is selected from the group consisting of 2, 3, 4, 6, 8, 9, 12 and 16, wherein, when updating the pixels of the second pixel data, the display driver is configured to append the M/N bit chunk to the initial value of the given colour component of the given pixel, to generate an updated value of the given colour component of the given pixel.

In another embodiment, for a given pixel of the second pixel data, the extra pixel data comprises at least one most significant bit of a previous output value of a given colour component of a corresponding pixel in an image frame displayed previously via the display, wherein, when updating the pixels of the second pixel data, the display driver is configured to:

determine an amount of overdrive or underdrive required to be applied to an initial value of the given colour component of the given pixel comprised in the second pixel data, based on a difference between the at least one most significant bit of the previous output value and the initial value of the given colour component of the given pixel; and apply the determined amount of overdrive or underdrive to the initial value of the given colour component of the given pixel, to generate an updated value of the given colour component of the given pixel.

In yet another embodiment, the extra pixel data comprises information indicative of an amount of overdrive or underdrive required to be applied to an initial value of a given colour component of a given pixel comprised in the second pixel data, wherein, when updating the pixels of the second pixel data, the display driver is configured to apply the amount of overdrive or underdrive to the initial value of the given colour component of the given pixel, to generate an updated value of the given colour component of the given pixel.

In still another embodiment, the extra pixel data comprises an extra pixel for a given group of neighbouring pixels in the second pixel data from which pixel values of a corresponding region of the display area are to be determined, and wherein, when generating the control signal, the display driver is configured to determine, from the neighbouring pixels of the given group and the extra pixel, the pixel values of the corresponding region of the display area.

Optionally, the given group of neighbouring pixels comprises four pixels in a quadrilateral arrangement, and wherein, when updating the pixels of the second pixel data, the display driver is configured to:

rearrange the four pixels by increasing a distance between each of the four pixels and a centre of the given group; and arrange the extra pixel at the centre of the given group.

Optionally, the input signal comprises information pertaining to a region within the display area of the display whereat the pixels of the second pixel data pertaining to the second image frame are to be displayed, and wherein the display driver is configured to generate the control signal in a manner that the updated pixels of the second pixel data are displayed at said region within the display area, while the re-scaled pixels of the first pixel data are displayed at a remaining region within the display area.

The present disclosure also relates to the method as described above. Various embodiments and variants disclosed above, with respect to the aforementioned first aspect and second aspect, apply mutatis mutandis to the method. Optionally, the method is performed by the display driver to advantageously utilise the extra pixel data to improve the quality of the pixels of the second pixel data. Optionally, the display driver executes the method to present the visual scene at the display.

In an embodiment, for a given pixel of the second pixel data, the extra pixel data comprises an M/N bit chunk that is to be added to an initial value of a given colour component of the given pixel comprised in the second pixel data, wherein M is a colour depth of the pixels of the first pixel data, and N is selected from the group consisting of 2, 3, 4, 6, 8, 9, 12 and 16, wherein the step of updating the pixels of the second pixel data comprises appending the M/N bit chunk to the initial value of the given colour component of the given pixel, to generate an updated value of the given colour component of the given pixel.

In another embodiment, for a given pixel of the second pixel data, the extra pixel data comprises at least one most significant bit of a previous output value of a given colour component of a corresponding pixel in an image frame displayed previously via the display, wherein the step of updating the pixels of the second pixel data comprises:

determining an amount of overdrive or underdrive required to be applied to an initial value of the given colour component of the given pixel comprised in the second pixel data, based on a difference between the at least one most significant bit of the previous output value and the initial value of the given colour component of the given pixel; and applying the determined amount of overdrive or underdrive to the initial value of the given colour component of the given pixel, to generate an updated value of the given colour component of the given pixel.

In yet another embodiment, the extra pixel data comprises information indicative of an amount of overdrive or underdrive required to be applied to an initial value of a given colour component of a given pixel comprised in the second pixel data, wherein the step of updating the pixels of the second pixel data comprises applying the amount of overdrive or underdrive to the initial value of the given colour component of the given pixel, to generate an updated value of the given colour component of the given pixel.

In still another embodiment, the extra pixel data comprises an extra pixel for a given group of neighbouring pixels in the second pixel data from which pixel values of a corresponding region of the display area are to be determined, and wherein the step of generating the control signal comprises determining, from the neighbouring pixels of the given group and the extra pixel, the pixel values of the corresponding region of the display area.

Optionally, wherein the given group of neighbouring pixels comprises four pixels in a quadrilateral arrangement, and wherein the step of updating the pixels of the second pixel data comprises:

rearranging the four pixels by increasing a distance between each of the four pixels and a centre of the given group; and arranging the extra pixel at the centre of the given group.

Optionally, the input signal comprises information pertaining to a region within the display area of the display whereat the pixels of the second pixel data pertaining to the second image frame are to be displayed, and wherein the step of generating the control signal is performed in a manner that the updated pixels of the second pixel data are displayed at said region within the display area, while the re-scaled pixels of the first pixel data are displayed at a remaining region within the display area.

DETAILED DESCRIPTION OF THE DRAWINGS

Referring to FIG. 1, illustrated is a block diagram of architecture of a display apparatus 100, in accordance with an embodiment of the present disclosure. The display apparatus 100 comprises a display 102, a display driver 104, and a processor 106. The display driver 104 is connected to the display 102, and the processor 106 is connected to the display driver 104.

Referring to FIGS. 2A and 2B, FIG. 2A is an exemplary illustration of a first part 202 and a second part 204 of an input signal 200, while FIG. 2B is an exemplary illustration of pixels constituting a visual scene, in accordance with an embodiment of the present disclosure. In FIG. 2A, the first part 202 of the input signal 200 comprises first pixel data (having pixels A, B, C, D, E, F, G, and H) and extra pixel data (depicted as Z1, Z2, Z3, and Z4), while the second part 204 of the input signal 200 comprises second pixel data (having pixels X1, X2, X3, and X4). In FIG. 2B, it is shown that the pixel A of the first pixel data is re-scaled to obtain pixels A1, A2, A3 and A4; the pixel B of the first pixel data is re-scaled to obtain pixels B1, B2, B3, and B4; the pixel C of the first pixel data is re-scaled to obtain pixels C1, C2, C3, and C4; and so on until the pixel H of the first pixel data is re-scaled to obtain pixels H1, H2, H3 and H4. Moreover, the pixels X1, X2, X3, and X4 of the second pixel data are updated based on the extra pixel data Z1, Z2, Z3, and Z4, respectively. Updated pixels of the second pixel data are represented as (Z1, X1), (Z2, X2), (Z3, X3), and (Z4, X4) in FIG. 2B, for the sake of simplicity. In the visual scene, the re-scaled pixels A1-A4, B1-B4, C1-C4, D1-D4, E1-E4, F1-F4, G1-G4, and H1-H4 of the first pixel data surround the updated pixels (Z1, X1), (Z2, X2), (Z3, X3), and (Z4, X4) of the second pixel data.

It may be understood by a person skilled in the art that the FIGS. 2A and 2B are merely examples for sake of clarity, which should not unduly limit the scope of the claims herein. The person skilled in the art will recognize many variations, alternatives, and modifications of embodiments of the present disclosure.

Figure 3B:
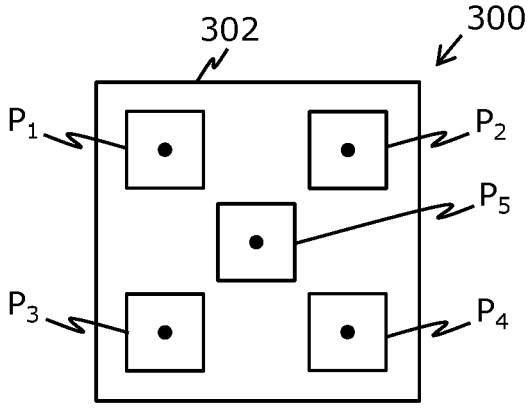
FIG. 3B illustrates how pixels of the second pixel data are updated, in accordance with an embodiment of the present disclosure.

Referring to FIGS. 3A and 3B, FIG. 3A illustrates a given group 300 of neighbouring pixels in second pixel data, while FIG. 3B illustrates how pixels of the second pixel data are updated, in accordance with an embodiment of the present disclosure. In FIG. 3A, the given group 300 of neighbouring pixels comprises four pixels P1, P2, P3, and P4 in a quadrilateral arrangement (depicted, for example, as a rectangle). In FIG. 3B, the four pixels P1, P2, P3, and P4 are rearranged by increasing a distance between each of the four pixels P1, P2, P3, and P4 and a centre of the given group 300, and an extra pixel P5 is arranged at the centre of the given group 300. A display driver (not shown) is configured to determine, from the neighbouring pixels of the given group 300 and the extra pixel P5, pixel values of a corresponding region 302 of a display area (not shown) of a display (not shown).

It may be understood by a person skilled in the art that the FIGS. 3A and 3B are merely examples for sake of clarity, which should not unduly limit the scope of the claims herein. The person skilled in the art will recognize many variations, alternatives, and modifications of embodiments of the present disclosure.

Figure 4:
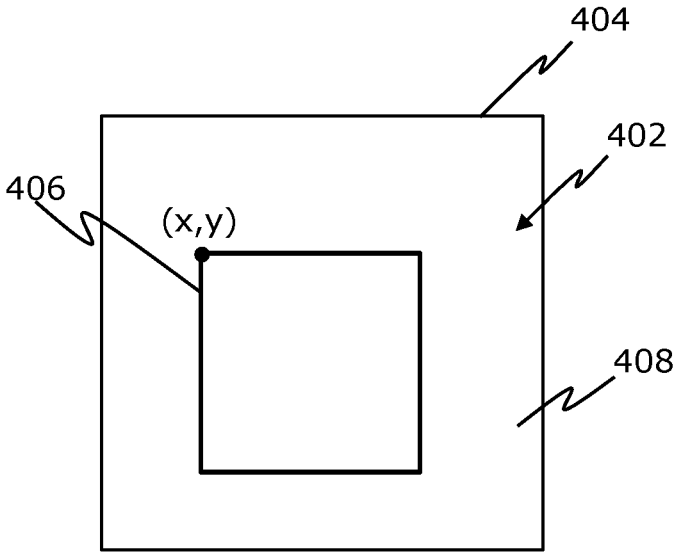
FIG. 4 illustrates a display area of a display, in accordance with an embodiment of the present disclosure.

Referring to FIG. 4, illustrated is a display area 402 of a display 404, in accordance with an embodiment of the present disclosure. Information pertaining to a region 406 within the display area 402 of the display 404 whereat pixels of second pixel data pertaining to a second image frame are to be displayed is comprised in an input signal. This information could be defined by a position (depicted as (x,y)) of one corner of the region 406 and dimensions of the region 406 in pixels. A display driver (not shown) is configured to generate a control signal in a manner that updated pixels of the second pixel data are displayed at said region 406 within the display area 402, while re-scaled pixels of first pixel data are displayed at a remaining region 408 within the display area 402.

Figure 5:
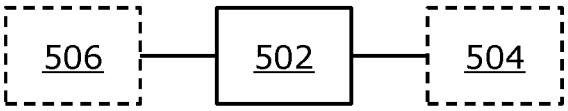
FIG. 5 illustrates an architecture of a display driver, in accordance with an embodiment of the present disclosure.

Referring to FIG. 5, illustrated is an architecture of a display driver 502, in accordance with an embodiment of the present disclosure. The display driver 502 is connected with a processor 504 and a display 506.

Figure 6:
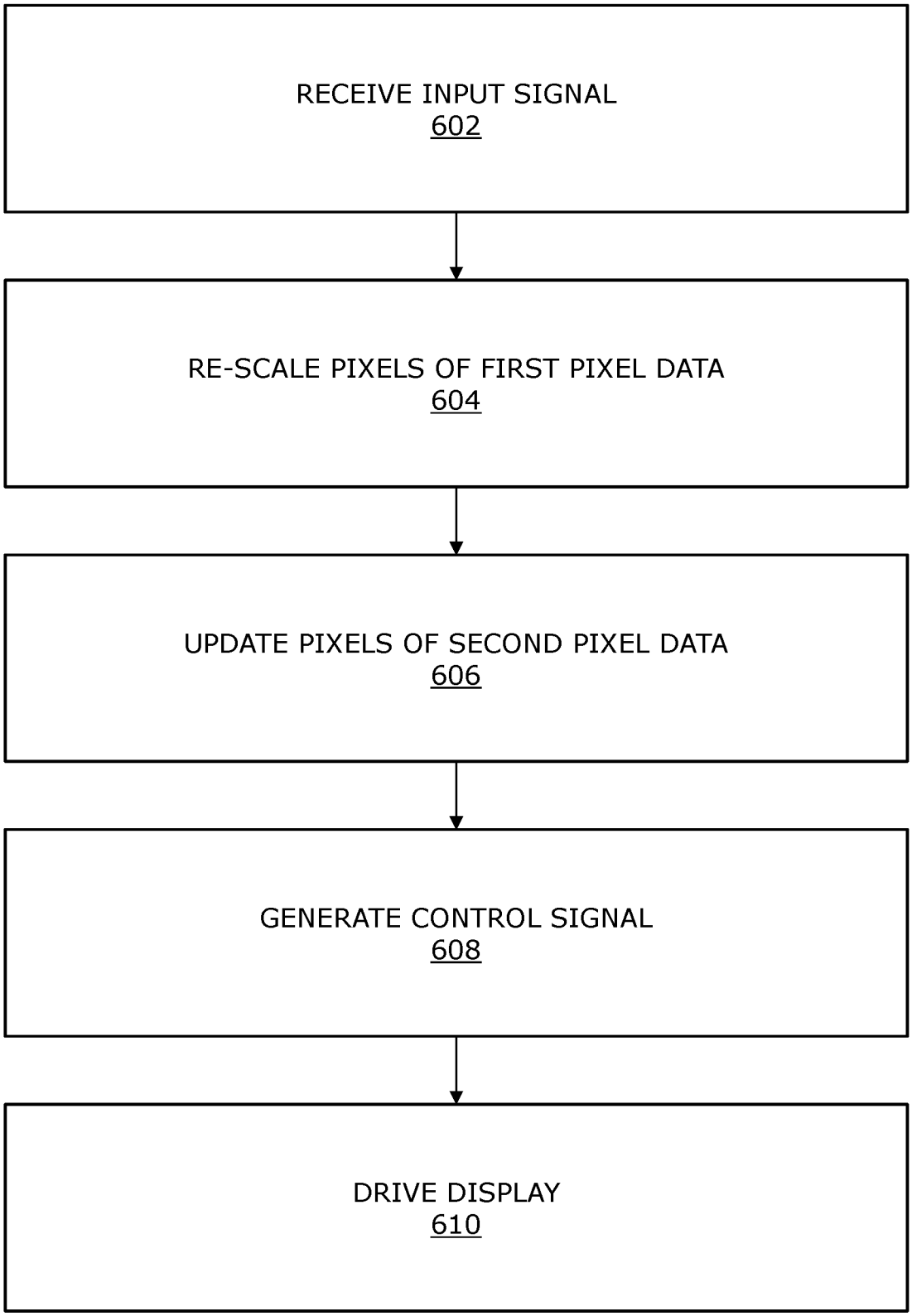
FIG. 6 illustrates steps of a method, in accordance with an embodiment of the present disclosure.

Referring to FIG. 6, illustrated are steps of a method, in accordance with an embodiment of the present disclosure. At step 602, an input signal is received at a display driver, wherein at least a first part and a second part of the input signal comprise first pixel data pertaining to a portion of a first image frame and second pixel data pertaining to a second image frame, respectively, wherein the first part of the input signal further comprises extra pixel data pertaining to the second image frame. At step 604, pixels of the first pixel data are re-scaled, at the display driver, based on a display resolution of a display. At step 606, pixels of the second pixel data are updated, at the display driver, based on the extra pixel data. At step 608, a control signal is generated, at the display driver, based on the re-scaled pixels of the first pixel data and the updated pixels of the second pixel data. At step 610, the display is driven using the control signal to present a visual scene, wherein the re-scaled pixels of the first pixel data surround the updated pixels of the second pixel data when displayed on a display area of the display.

The steps 602, 604, 606, 608, and 610 are only illustrative and other alternatives can also be provided where one or more steps are added, one or more steps are removed, or one or more steps are provided in a different sequence without departing from the scope of the claims herein.

Modifications to embodiments of the present disclosure described in the foregoing are possible without departing from the scope of the present disclosure as defined by the accompanying claims. Expressions such as "including", "comprising", "incorporating", "have", "is" used to describe and claim the present disclosure are intended to be construed in a non-exclusive manner, namely allowing for items, components or elements not explicitly described also to be present. Reference to the singular is also to be construed to relate to the plural.

What is claimed is:

1. A display apparatus comprising:

a display;

a display driver connected to the display; and a processor, connected to the display driver, configured to send an input signal to the display driver, wherein at least a first part and a second part of the input signal comprise first pixel data pertaining to a portion of a first image frame and second pixel data pertaining to a second image frame, respectively, wherein the first part of the input signal further comprises extra pixel data pertaining to the second image frame, wherein the display driver is configured to:

re-scale pixels of the first pixel data based on a display resolution of the display;

update pixels of the second pixel data based on the extra pixel data;

generate a control signal based on the re-scaled pixels of the first pixel data and the updated pixels of the second pixel data; and drive the display using the control signal to present a visual scene, wherein the re-scaled pixels of the first pixel data surround the updated pixels of the second pixel data when displayed on a display area of the display.

2. The display apparatus of claim 1, wherein, for a given pixel of the second pixel data, the extra pixel data comprises an M/N bit chunk that is to be added to an initial value of a given colour component of the given pixel comprised in the second pixel data, wherein M is a colour depth of the pixels of the first pixel data, and N is selected from a group consisting of 2, 3, 4, 6, 8, 9, 12 and 16, wherein, when updating the pixels of the second pixel data, the display driver is configured to append the M/N bit chunk to the initial value of the given colour component of the given pixel, to generate an updated value of the given colour component of the given pixel.

3. The display apparatus of claim 1, wherein, for a given pixel of the second pixel data, the extra pixel data comprises at least one most significant bit of a previous output value of a given colour component of a corresponding pixel in an image frame displayed previously via the display, wherein, when updating the pixels of the second pixel data, the display driver is configured to:

determine an amount of overdrive or underdrive required to be applied to an initial value of the given colour component of the given pixel comprised in the second pixel data, based on a difference between the at least one most significant bit of the previous output value and the initial value of the given colour component of the given pixel; and apply the determined amount of overdrive or underdrive to the initial value of the given colour component of the given pixel, to generate an updated value of the given colour component of the given pixel.

4. The display apparatus of claim 1, wherein, for a given pixel of the second pixel data, the processor is configured to determine an amount of overdrive or underdrive required to be applied to an initial value of a given colour component of the given pixel comprised in the second pixel data, based on a difference between a previous output value of the given colour component of a corresponding pixel in an image frame displayed previously via the display and the initial value of the given colour component of the given pixel, wherein the extra pixel data comprises information indicative of the determined amount of overdrive or underdrive required to be applied, wherein, when updating the pixels of the second pixel data, the display driver is configured to apply the determined amount of overdrive or underdrive to the initial value of the given colour component of the given pixel, to generate an updated value of the given colour component of the given pixel.

5. The display apparatus of claim 1, wherein the extra pixel data comprises an extra pixel for a given group of neighbouring pixels in the second pixel data from which pixel values of a corresponding region of the display area are to be determined, and wherein, when generating the control signal, the display driver is configured to determine, from the neighbouring pixels of the given group and the extra pixel, the pixel values of the corresponding region of the display area.

6. The display apparatus of claim 5, wherein the given group of neighbouring pixels comprises four pixels in a quadrilateral arrangement, and wherein, when updating the pixels of the second pixel data, the display driver is configured to:

rearrange the four pixels by increasing a distance between each of the four pixels and a centre of the given group; and arrange the extra pixel at the centre of the given group.

7. The display apparatus of claim 1, wherein the input signal comprises information pertaining to a region within the display area of the display whereat the pixels of the second pixel data pertaining to the second image frame are to be displayed, and wherein the display driver is configured to generate the control signal in a manner that the updated pixels of the second pixel data are displayed at said region within the display area, while the re-scaled pixels of the first pixel data are displayed at a remaining region within the display area.

8. A display driver implemented as a semiconductor integrated circuit, configured to:

receive an input signal from a processor, wherein at least a first part and a second part of the input signal comprise first pixel data pertaining to a portion of a first image frame and second pixel data pertaining to a second image frame, respectively, wherein the first part of the input signal further comprises extra pixel data pertaining to the second image frame;

re-scale pixels of the first pixel data based on a display resolution of a display;

update pixels of the second pixel data based on the extra pixel data;

generate a control signal based on the re-scaled pixels of the first pixel data and the updated pixels of the second pixel data; and drive the display using the control signal to present a visual scene, wherein the re-scaled pixels of the first pixel data surround the updated pixels of the second pixel data when displayed on a display area of the display.

9. The display driver of claim 8, wherein, for a given pixel of the second pixel data, the extra pixel data comprises an M/N bit chunk that is to be added to an initial value of a given colour component of the given pixel comprised in the second pixel data, wherein M is a colour depth of the pixels of the first pixel data, and N is selected from a group consisting of 2, 3, 4, 6, 8, 9, 12 and 16, wherein, when updating the pixels of the second pixel data, the display driver is configured to append the M/N bit chunk to the initial value of the given colour component of the given pixel, to generate an updated value of the given colour component of the given pixel.

10. The display driver of claim 8, wherein, for a given pixel of the second pixel data, the extra pixel data comprises at least one most significant bit of a previous output value of a given colour component of a corresponding pixel in an image frame displayed previously via the display, wherein, when updating the pixels of the second pixel data, the display driver is configured to:

determine an amount of overdrive or underdrive required to be applied to an initial value of the given colour component of the given pixel comprised in the second pixel data, based on a difference between the at least one most significant bit of the previous output value and the initial value of the given colour component of the given pixel; and apply the determined amount of overdrive or underdrive to the initial value of the given colour component of the given pixel, to generate an updated value of the given colour component of the given pixel.

11. The display driver of claim 8, wherein the extra pixel data comprises information indicative of an amount of overdrive or underdrive required to be applied to an initial value of a given colour component of a given pixel comprised in the second pixel data, wherein, when updating the pixels of the second pixel data, the display driver is configured to apply the amount of overdrive or underdrive to the initial value of the given colour component of the given pixel, to generate an updated value of the given colour component of the given pixel.

12. The display driver of claim 8, wherein the extra pixel data comprises an extra pixel for a given group of neighbouring pixels in the second pixel data from which pixel values of a corresponding region of the display area are to be determined, and wherein, when generating the control signal, the display driver is configured to determine, from the neighbouring pixels of the given group and the extra pixel, the pixel values of the corresponding region of the display area.

13. The display driver of claim 12, wherein the given group of neighbouring pixels comprises four pixels in a quadrilateral arrangement, and wherein, when updating the pixels of the second pixel data, the display driver is configured to:

rearrange the four pixels by increasing a distance between each of the four pixels and a centre of the given group; and arrange the extra pixel at the centre of the given group.

14. The display driver of claim 8, wherein the input signal comprises information pertaining to a region within the display area of the display whereat the pixels of the second pixel data pertaining to the second image frame are to be displayed, and wherein the display driver is configured to generate the control signal in a manner that the updated pixels of the second pixel data are displayed at said region within the display area, while the re-scaled pixels of the first pixel data are displayed at a remaining region within the display area.

15. A method comprising:

receiving an input signal at a display driver, wherein at least a first part and a second part of the input signal comprise first pixel data pertaining to a portion of a first image frame and second pixel data pertaining to a second image frame, respectively, wherein the first part of the input signal further comprises extra pixel data pertaining to the second image frame, re-scaling, at the display driver, pixels of the first pixel data based on a display resolution of a display;

updating, at the display driver, pixels of the second pixel data based on the extra pixel data;

generating, at the display driver, a control signal based on the re-scaled pixels of the first pixel data and the updated pixels of the second pixel data; and driving the display using the control signal to present a visual scene, wherein the re-scaled pixels of the first pixel data surround the updated pixels of the second pixel data when displayed on a display area of the display.

16. The method of claim 15, wherein, for a given pixel of the second pixel data, the extra pixel data comprises an M/N bit chunk that is to be added to an initial value of a given colour component of the given pixel comprised in the second pixel data, wherein M is a colour depth of the pixels of the first pixel data, and N is selected from a group consisting of 2, 3, 4, 6, 8, 9, 12 and 16, wherein the step of updating the pixels of the second pixel data comprises appending the M/N bit chunk to the initial value of the given colour component of the given pixel, to generate an updated value of the given colour component of the given pixel.

17. The method of claim 15, wherein, for a given pixel of the second pixel data, the extra pixel data comprises at least one most significant bit of a previous output value of a given colour component of a corresponding pixel in an image frame displayed previously via the display, wherein the step of updating the pixels of the second pixel data comprises:

determining an amount of overdrive or underdrive required to be applied to an initial value of the given colour component of the given pixel comprised in the second pixel data, based on a difference between the at least one most significant bit of the previous output value and the initial value of the given colour component of the given pixel; and applying the determined amount of overdrive or underdrive to the initial value of the given colour component of the given pixel, to generate an updated value of the given colour component of the given pixel.

18. The method of claim 15, wherein the extra pixel data comprises information indicative of an amount of overdrive or underdrive required to be applied to an initial value of a given colour component of a given pixel comprised in the second pixel data, wherein the step of updating the pixels of the second pixel data comprises applying the amount of overdrive or underdrive to the initial value of the given colour component of the given pixel, to generate an updated value of the given colour component of the given pixel.

19. The method of claim 15, wherein the extra pixel data comprises an extra pixel for a given group of neighbouring pixels in the second pixel data from which pixel values of a corresponding region of the display area are to be determined, and wherein the step of generating the control signal comprises determining, from the neighbouring pixels of the given group and the extra pixel, the pixel values of the corresponding region of the display area.

20. The method of claim 19, wherein the given group of neighbouring pixels comprises four pixels in a quadrilateral arrangement, and wherein the step of updating the pixels of the second pixel data comprises:

rearranging the four pixels by increasing a distance between each of the four pixels and a centre of the given group; and arranging the extra pixel at the centre of the given group.

21. The method of claim 15, wherein the input signal comprises information pertaining to a region within the display area of the display whereat the pixels of the second pixel data pertaining to the second image frame are to be displayed, and wherein the step of generating the control signal is performed in a manner that the updated pixels of the second pixel data are displayed at said region within the display area, while the re-scaled pixels of the first pixel data are displayed at a remaining region within the display area.

* * * * *